US010472870B2

(12) United States Patent
Tassi et al.

(10) Patent No.: US 10,472,870 B2
(45) Date of Patent: Nov. 12, 2019

(54) DEVICE FOR AUTOMATIC CLOSING OF A DOOR

(71) Applicant: Anselmi & C. S.r.l., Roncade (Treviso) (IT)

(72) Inventors: Alberto Tassi, Roncade (IT); Giulio Anselmi, Roncade (IT)

( * ) Notice: Subject to any disclaimer, the term of this patent is extended or adjusted under 35 U.S.C. 154(b) by 0 days.

(21) Appl. No.: 16/306,599

(22) PCT Filed: Jun. 9, 2017

(86) PCT No.: PCT/IB2017/053426
§ 371 (c)(1),
(2) Date: Dec. 3, 2018

(87) PCT Pub. No.: WO2017/212453
PCT Pub. Date: Dec. 14, 2017

(65) Prior Publication Data

US 2019/0136596 A1 May 9, 2019

(30) Foreign Application Priority Data

Jun. 10, 2016 (IT) ..... UA2016A004276
Nov. 18, 2016 (IT) ..... 102016000116925

(51) Int. Cl.
*E05D 3/18* (2006.01)
*E05F 3/10* (2006.01)
(Continued)

(52) U.S. Cl.
CPC ..... *E05D 3/186* (2013.01); *E05F 1/12* (2013.01); *E05F 3/10* (2013.01); *E05F 3/108* (2013.01);
(Continued)

(58) Field of Classification Search
CPC ..... E05D 3/186; E05D 3/18; E05D 3/183; E05D 7/0009; E05D 7/04; E05D 7/0415;
(Continued)

(56) References Cited

U.S. PATENT DOCUMENTS 882,721 A * 3/1908 Soss ..... E05F 3/20 16/68
897,825 A * 9/1908 Flynn ..... E05F 3/108 16/61
(Continued)

FOREIGN PATENT DOCUMENTS

GB 1252757 11/1971
WO 2015145364 10/2015

*Primary Examiner* — Jeffrey O'Brien
(74) *Attorney, Agent, or Firm* — Themis Law

(57) ABSTRACT

A device for automatic closing of a door, to be applied to a hidden hinge having two bodies articulated with each other by a pair of arms and adapted to be constrained to one of the two bodies and to be inserted, together with the body, into a cavity obtained in the leaf, includes a translating element to be engaged with an articulation arm of the hinge; an elastic member interposed between a first element associated with the translating element and a second element associated with the body of the hinge, and configured to be loaded during the opening of the leaf and to cause the automatic closing of the leaf by releasing the stored energy; and a system that varies the preloading of the elastic member and is configured to modify the distance between the first and the second elements, between which the elastic member is interposed.

20 Claims, 10 Drawing Sheets

Figure 1:
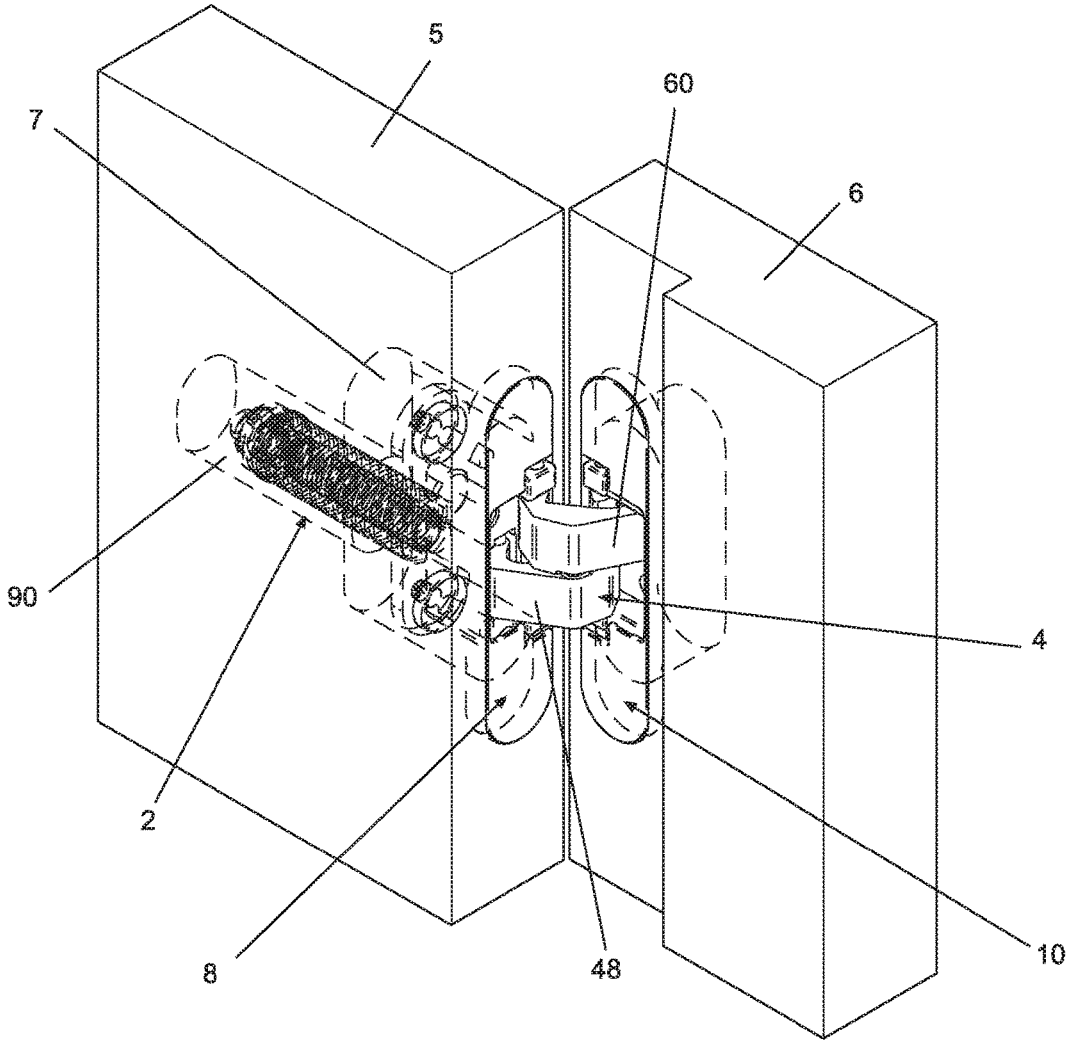

(51) Int. Cl.
*E05F 3/20* (2006.01)
*E05F 1/12* (2006.01)
*E05F 3/14* (2006.01)

(52) U.S. Cl.
CPC *E05F 3/20* (2013.01); *E05F 3/14* (2013.01); *E05Y 2201/21* (2013.01); *E05Y 2201/492* (2013.01); *E05Y 2600/41* (2013.01); *E05Y 2900/132* (2013.01)

(58) Field of Classification Search
CPC ..... E05D 7/0423; E05D 7/043; E05D 2007/0438; E05D 2007/0446; E05D 2007/0453; E05D 2007/0476; E05D 2007/0484; E05F 1/12; E05F 3/10; E05F 3/108; E05F 3/20; E05F 3/14; G02C 5/2236; G02C 5/2245
See application file for complete search history.

(56) References Cited

U.S. PATENT DOCUMENTS 1,926,431 A * 9/1933 Busch ..... E05F 1/1253 16/287
3,531,820 A 10/1970 Koivusalo
4,000,540 A * 1/1977 Newlon ..... E05F 1/1253 16/298
4,747,183 A * 5/1988 Drlik ..... G02C 5/2236 16/228
4,875,252 A * 10/1989 Falconer ..... E05D 3/186 16/288
5,165,060 A * 11/1992 Huang ..... G02C 5/146 351/113
8,627,547 B2 * 1/2014 Soh ..... E05D 11/0081 16/298
9,459,466 B2 * 10/2016 Wang ..... G02C 5/16
2018/0010373 A1 * 1/2018 Miglioranzo ..... E05D 3/186
2018/0363347 A1 * 12/2018 Chang ..... E05D 5/12

* cited by examiner

DEVICE FOR AUTOMATIC CLOSING OF A DOOR

The present invention relates to an improved device for automatic closing of a leaf, for example of a closet or a door, which is articulated by means of a hinge to a fixed structure or jamb, for example of a closet or a door.

There are known devices for the automatic closing of a leaf provided with movable outer arms, which are articulated to the leaf itself. These devices are not completely satisfactory because they are cumbersome and do not have a very pleasant appearance.

Hidden devices and devices recessed in the thickness of the leaf are also known, also referred to as concealed door closing devices. They are rather complicated both to be manufactured and mounted and installed; moreover, once they have been mounted and installed on the leaf, such devices may no longer be adjusted and in particular, do not allow the automatic closing speed of the leaf to be adjusted unless the device itself and the hinge associated therewith are removed from the leaf.

For example, in the door closing device of WO 2015/145364, the adjustment means of the closing speed of the leaf are positioned at the rear end of the tubular containment structure of the door closing device and therefore, once the latter has been inserted into the corresponding cavity obtained in the leaf, such a rear end is no longer accessible/visible from the outside and this prevents further adjustments to be made to the automatic closing speed of the leaf itself.

GB 2503753 describes a hinge with a door closing device in which the hinge is provided with several means for adjusting the position/orientation thereof along the three axes with respect to the jamb, at the time of installation.

In particular, the solution of GB 2503753, as well as the solutions of GB 1252757, U.S. Pat. No. 897,825 and DE 1584230, do not provide any means for easily adjusting the closing speed of the leaf once the door closing device has been inserted into the corresponding housing cavity obtained in the leaf.

It is the object of the present invention to propose an improved device for automatic closing of a door which overcomes the drawbacks of the traditional solutions and which allows the automatic closing speed of the leaf itself to be easily adjusted, also once the device has been mounted in the leaf.

It is another object of the invention to propose a device for closing a door which may be associated with different types of hinges, and in particular with existing hinges.

It is another object of the invention to propose a device for closing a door which may be installed and adjusted in a simple, easy, quick and accurate manner.

It is another object of the invention to propose a compact device for closing a door with a small number of components.

It is another object of the invention to propose a device for closing a door which has a significantly lower production cost with respect to traditional ones.

It is another object of the invention to propose a device for closing a door which once it is installed in the leaf, is completely concealed.

It is another object of the invention to propose a device for closing a door which has an alternative characterization with respect to traditional ones, both in terms of construction and operation.

It is another object of the invention to propose a device for closing a door which does not use a cam system.

It is another object of the invention to propose a device for closing a door which allows the closing speed of the leaf to be adjusted and decreased as the leaf moves close to the jamb.

These objects, both individually and in any combination thereof, and others which will become apparent from the description below, are achieved according to the invention, by means of an improved device for automatic closing of a door as described hereinafter and by means of an automatic closing system of a leaf with respect to a fixed structure also as described hereinafter.

Figure 2:
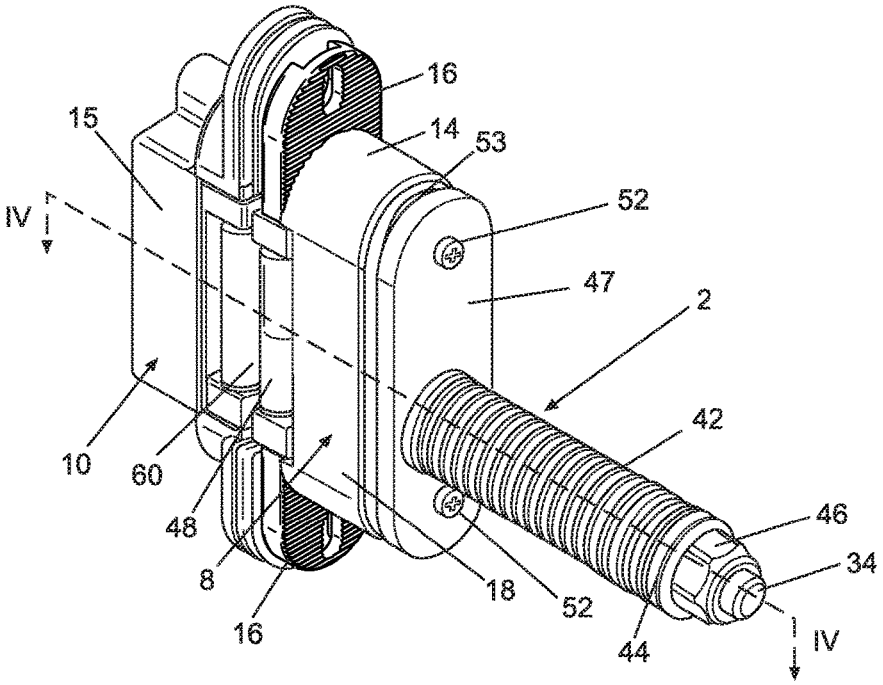
Figure 3:
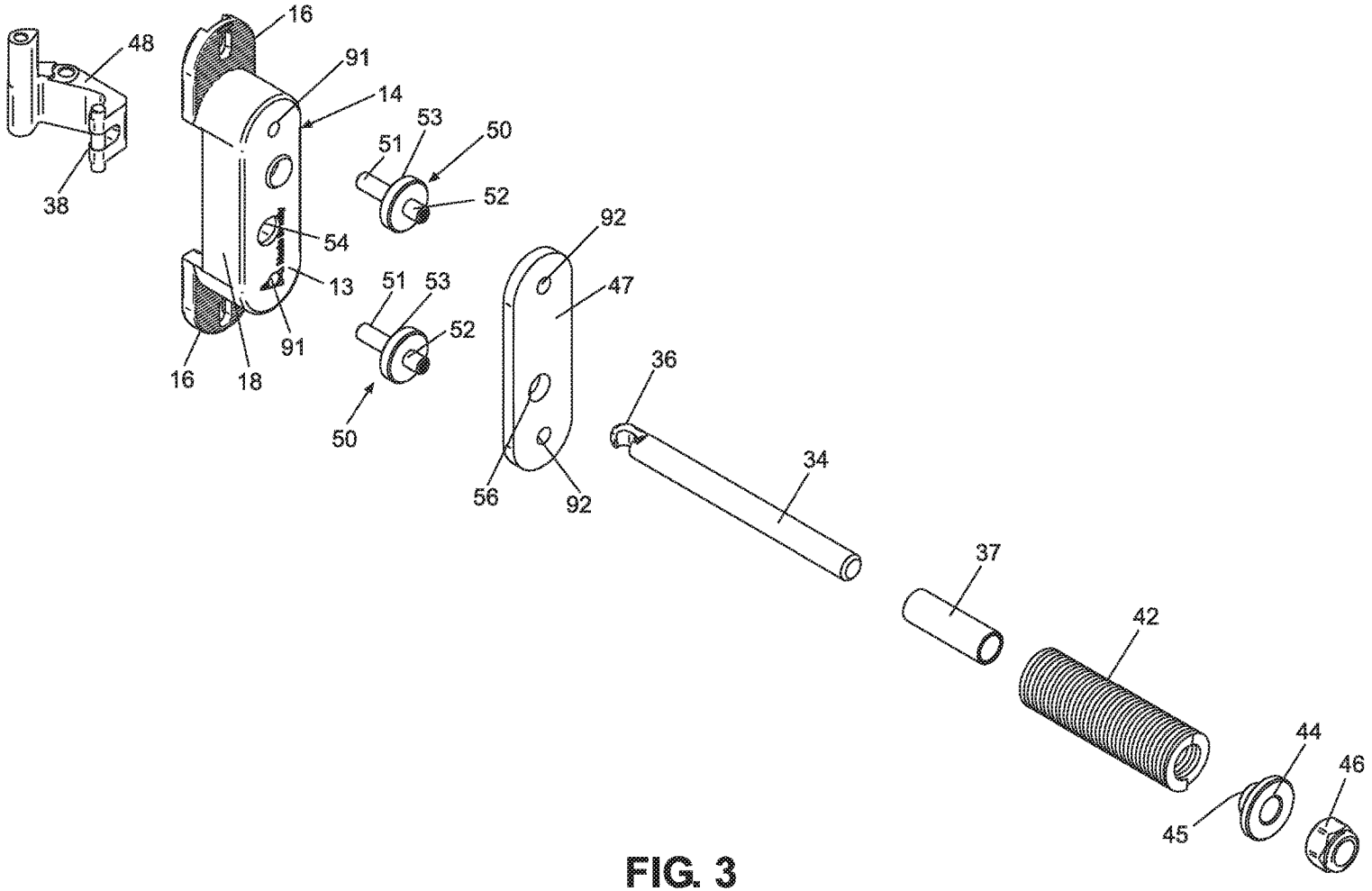
Figure 4:
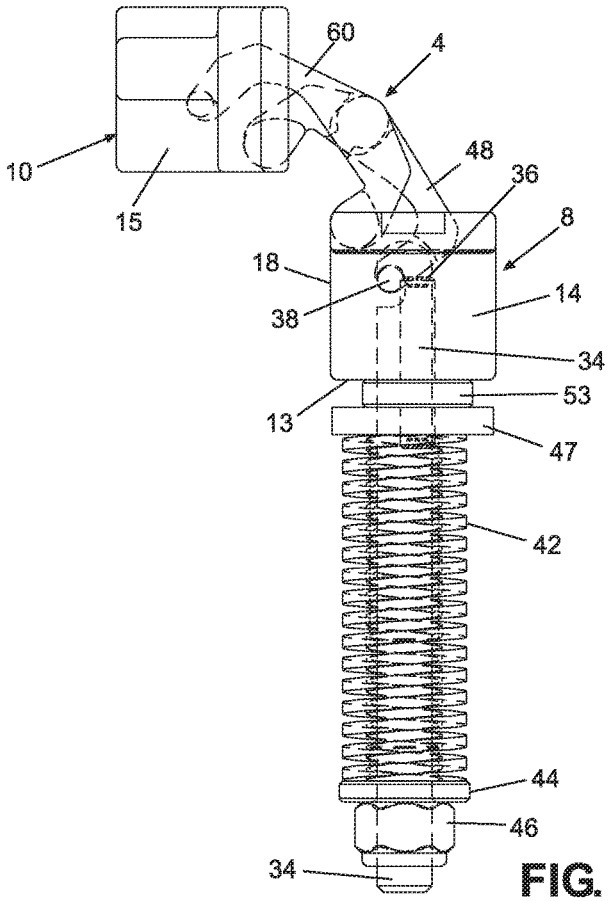
Figure 5:
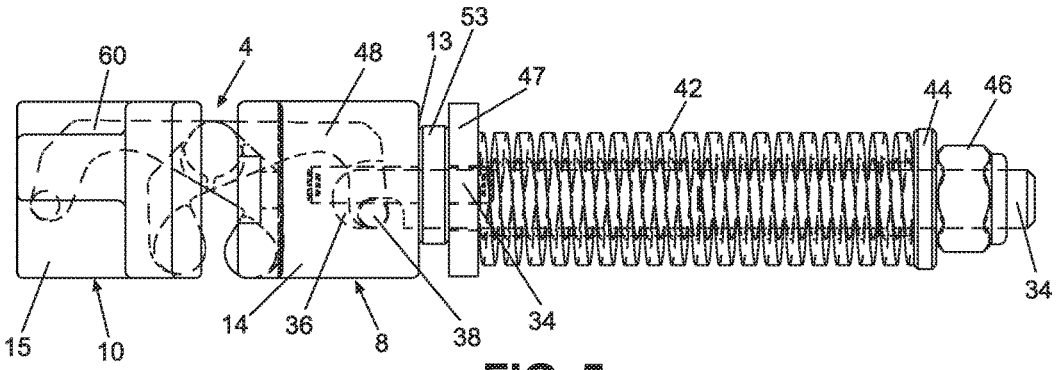
Figure 6:
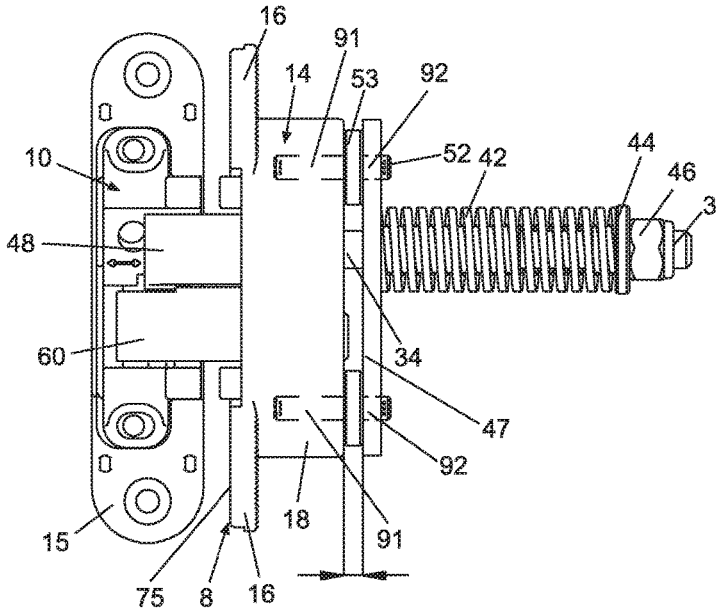
Figure 8:
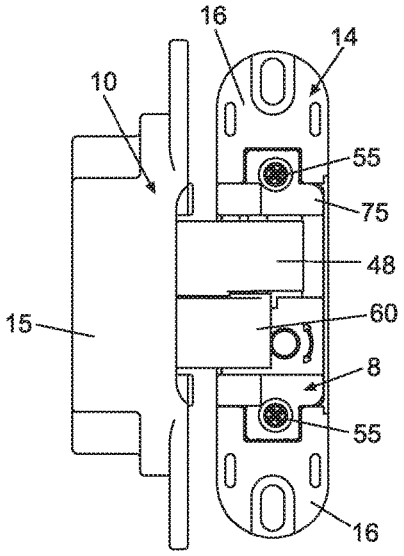
Figure 7:
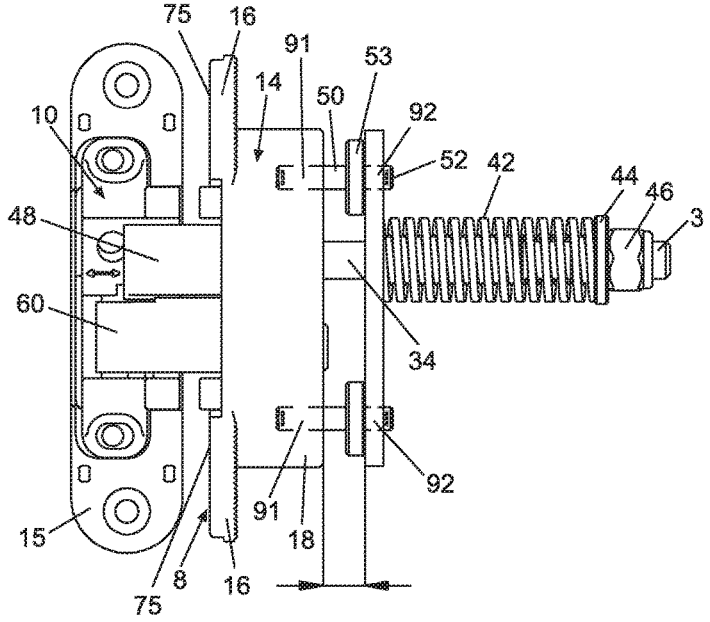
Figure 9:
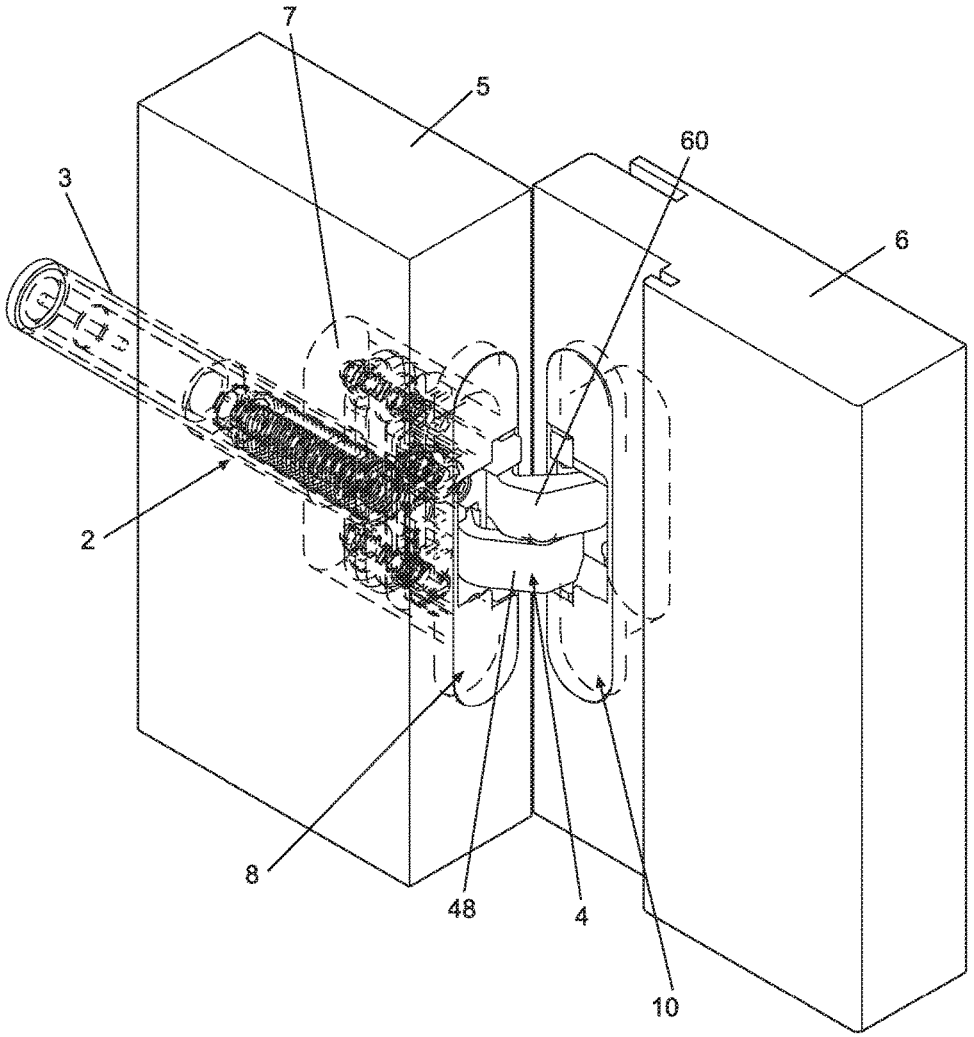
Figure 10:
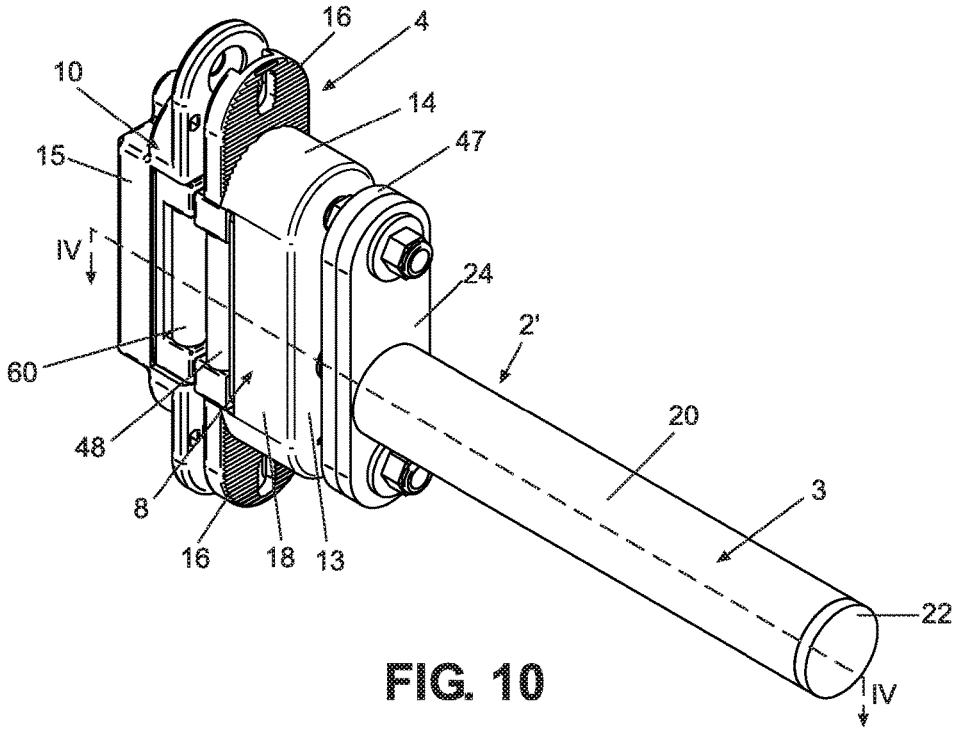
Figure 11:
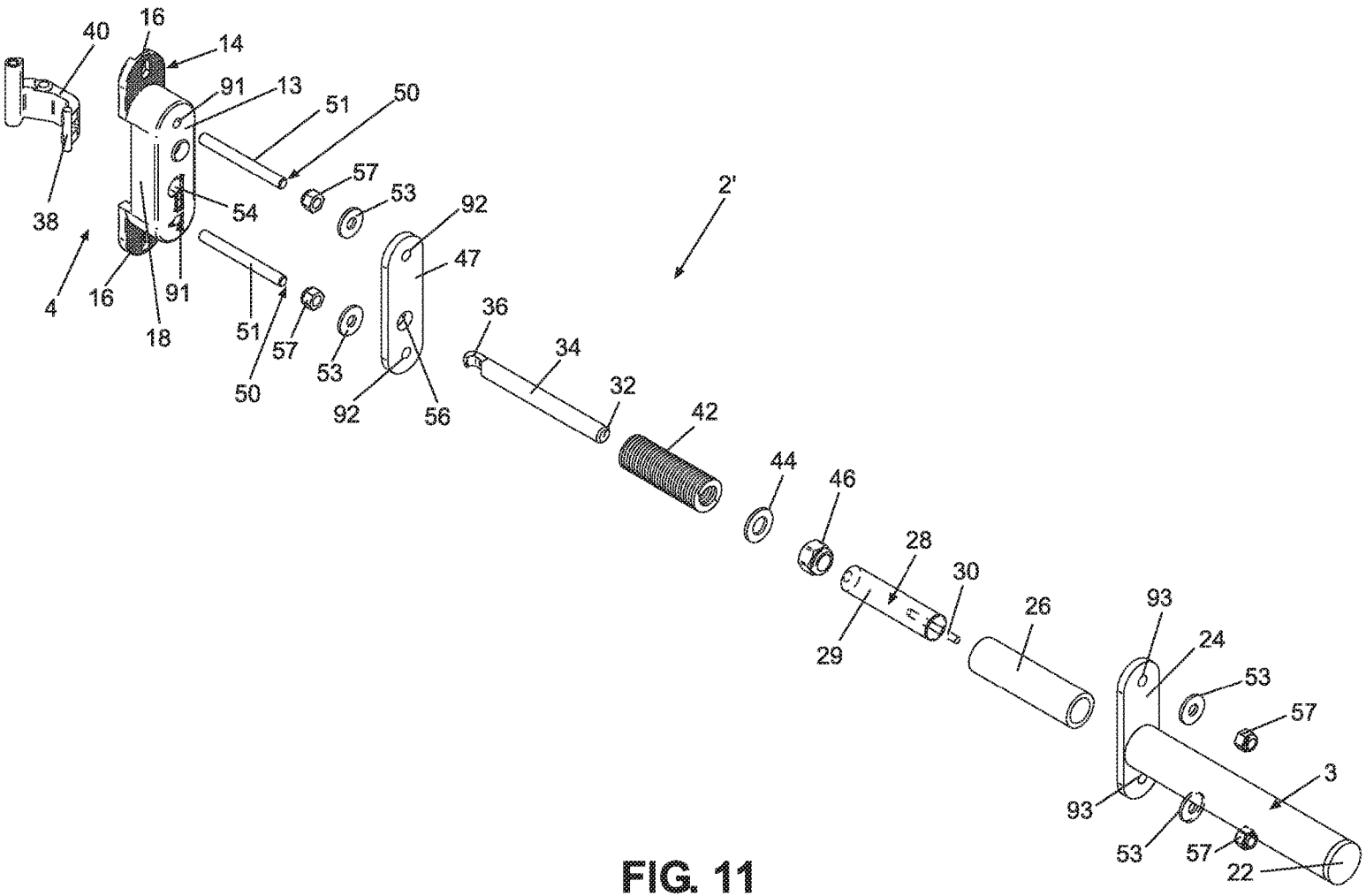
Figure 12:
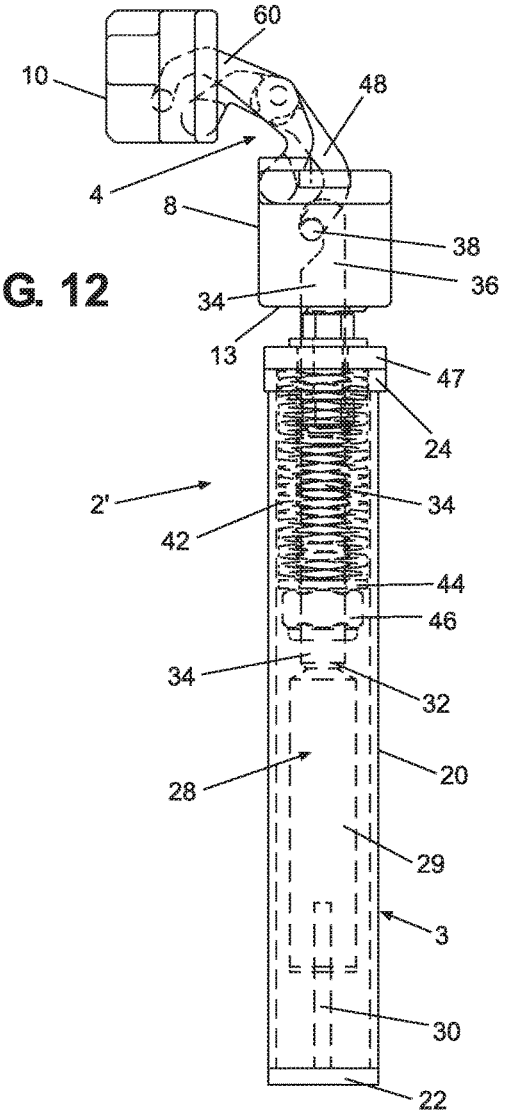
Figure 13:
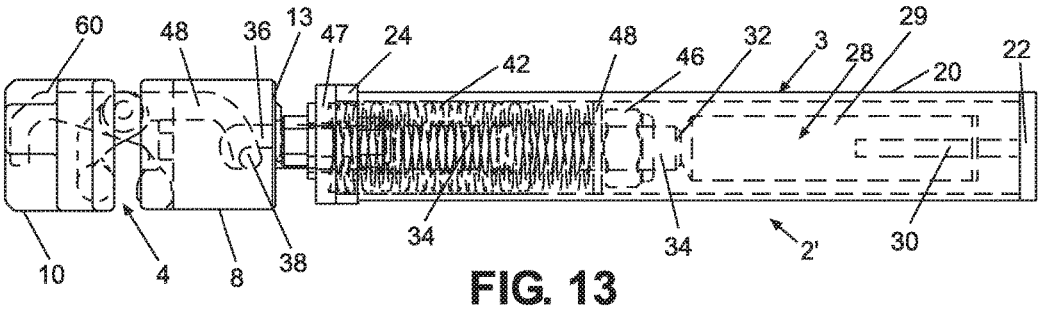
Figure 14:
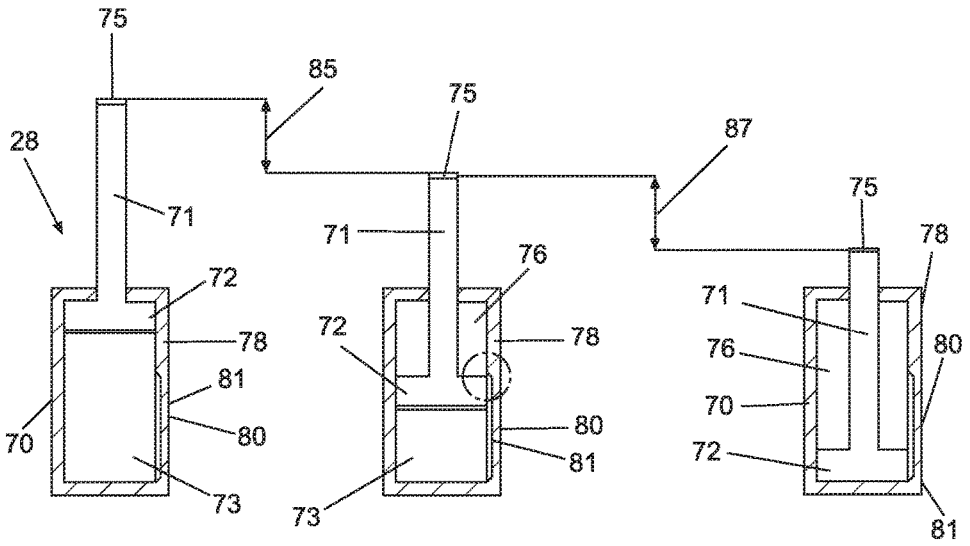
Figure 15:
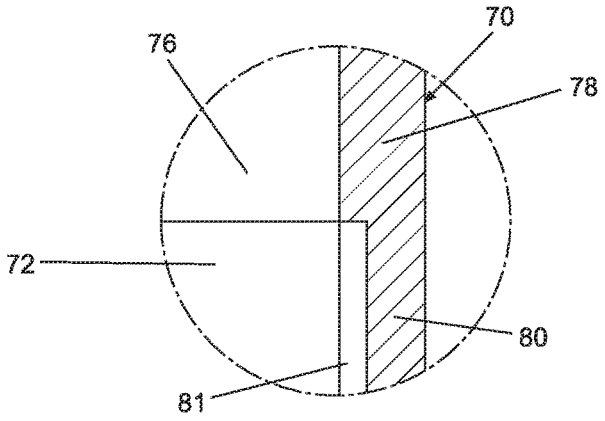

The present invention is hereinbelow further clarified in certain preferred embodiments thereof, which are described by mere way of non-limiting example, with reference to the accompanying drawings, in which:

FIG. 1 shows a perspective and dashed view of a first embodiment of the improved device for closing a door according to the invention, applied to a hinge, in open condition, for articulation of a leaf with respect to a jamb, FIG. 2 shows a perspective view thereof, applied to an articulation hinge in closed condition, FIG. 3 shows an exploded perspective view thereof, FIG. 4 shows it according to the longitudinal section IV-IV in FIG. 2, in open hinge condition, FIG. 5 shows it in the same view of FIG. 4, in closed hinge condition, FIG. 6 shows it according to a side view in a first adjustment state, in open hinge condition, FIG. 7 shows it in the same view of FIG. 6, in a different adjustment state, FIG. 8 shows it according to a front view, FIG. 9 shows a perspective and dashed view of a second embodiment of the improved device for closing a door according to the invention, applied to a hinge, in open condition, for articulation of a leaf with respect to a jamb, FIG. 10 shows a perspective view thereof, applied to an articulation hinge in closed condition, FIG. 11 shows an exploded perspective view thereof, FIG. 12 shows it according to the longitudinal section IV-IV in FIG. 10, in open hinge condition, FIG. 13 shows it in the same view of FIG. 12, in closed hinge condition, FIG. 14 shows a diagrammatic view of a damper of the device for closing a door according to the second embodiment, when switching from the open hinge condition to the closed hinge condition, and FIG. 15 shows an enlarged detail of FIG. 14.

As seen in the drawings, the improved device 2, 2' for automatic closing of a door according to the invention is intended to be associated with a hinge 4 for articulating a leaf 5 with respect to a fixed structure, for example with respect to a jamb 6 of a door, and is intended to be recessed in a corresponding housing cavity 7 obtained in the articulated leaf 5 with respect to said fixed structure.

Preferably, hinge 4 is of the hidden type because it is concealed when leaf 5 is closed. Moreover, hinge 4 preferably is of the type which allows to make rotation movements of the leaf 5 up to about 180° with respect to the fixed structure 6.

In particular, hinge 4 comprises two hinge bodies 8, 10 connected to each other by a pair of rocker-shaped arms 48, 60, which allow the rotation of leaf 5 with respect to jamb 6.

The hinge bodies 8, 10 comprise two flanged containers 14, 15, respectively, both cup-shaped, which are recessed in the thickness of leaf 5 and of jamb 6, respectively, and two corresponding blocks which are accommodated and may be adjusted in the respective flanged containers. In one embodiment not depicted herein, each flanged container 14, 15 may be provided in a single piece with the corresponding block.

In greater detail, each flanged container 14 and 15 of the hinge bodies 8, 10 has two flat end flanges 16 which are separated from each other by an intermediate portion 18 which is substantially parallelepiped-shaped, except the rounding of the two smaller facing walls thereof.

It is worth noting that hereinafter, the "closed" condition of hinge 4 means the condition in which the leaf is closed and the two hinge bodies 8, 10 are facing each other (see FIGS. 2, 5, 10 and 13). The "open" condition of hinge 4 instead means the condition in which the two hinge bodies 8, 10 are no longer facing each other (see FIGS. 1, 4, 9 and 12).

Furthermore, "opening the hinge or the leaf" means the rotation of leaf 5 to cause hinge 4 to pass from the closed condition to the open condition. Correspondingly, "closing the hinge or the leaf" means the rotation of the leaf to bring back hinge 4 to pass from the open condition to the closed condition.

Advantageously, in the first embodiment shown in FIGS. 1 to 8, device 2 for closing a door does not have a containment body and is accommodated directly in a tubular stretch 90 defined in the housing cavity 7 obtained in leaf 5.

Device 2 for closing a door preferably comprises a rod-shaped translating element 34, which is intended to be hooked with an end thereof to an articulation arm 48 of hinge 4. In particular, the translating element 34 has at one end, a hook 36 intended to be engaged directly with a pin 38 provided at the end of one of the articulation arms 48 of hinge 4.

Device 2 for closing a door also comprises elastic means 42 and in particular, a spring 42, preferably of the solenoid type, which is fitted about the translating element 34 and acts by compression between a first element 44, which is associated and integral with the translating element 34, and a second element 47, which is associated and integral with the body 8 of hinge 4.

Preferably, said first element, which is associated and integral with the translating element 34, comprises a washer 44 which is constrained to the latter by a self-locking nut 46 which engages on a corresponding threaded end portion provided in the translating element itself.

Advantageously, there may also be provided, about the translating element 34 and in the helical spring 42, a tubular element 37, e.g. a bush, for guiding the spring itself.

Preferably, washer 44 may have a tubular projection 45 about which the solenoid spring 42 engages, while the translating element 34 crosses the hole defined within the projection itself; conveniently, the solenoid spring 42 and the translating element 34 thereby are mutually centered and kept coaxial.

In greater detail, spring 42 rests on one face of washer 44 while nut 46 acts at the other face of the latter.

Advantageously, said second element, on which spring 42 acts, comprises a plate 47 which faces and is associated with the lower base 13 of the flanged container 14 of the hinge body 8 intended to be recessed in leaf 5. Preferably, plate 47 has the same shape as the lower base 13 of the intermediate portion 18 of the flanged container 14 of hinge 4.

Advantageously, by screwing the self-locking nut 46 onto the threaded portion of the translating element 34, the position of washer 44 held by said nut is varied with respect to plate 47, and thus a preliminary adjustment of the preloading level of spring 42 is carried out when the door closing device 2 is assembled, and in any case before the installation of the hinge body 8 on leaf 5.

Plate 47 is associated with base 13 of the intermediate portion 18 of the flanged container 14 of the hinge body 8 by means of adjustable joining means 50.

Conveniently, the joining means 50 comprise screws 51 with an outer threaded portion which is screwed/unscrewed in/from a corresponding threaded portion obtained on the inner surface of the holes 91 provided in the flanged container 14 of the hinge body 8.

Advantageously, spacer discs 53 are provided between plate 47 and the lower base 13, which spacer discs are inserted in or provided in one piece with the shank of the screws 51.

Conveniently, also plate 47 is provided with a pair of through holes 92 which are aligned with the holes 91 obtained in the hinge body 8 and are intended to be crossed by the joining means 50. In greater detail, the joining means 50 comprise end pins 52 which are constrained to or provided in one piece with the screws 51 and are engaged in the holes 92 obtained in plate 47.

Advantageously, in one variant (not depicted), the joining means 50 may comprise suitable locking means, e.g. nuts, which interact with a corresponding threaded portion of the screws 51 so as to thus overall define a bolt join which is easy to be disassembled and adjusted.

Advantageously, as depicted in FIG. 8, head 55 of the joining means 50, i.e. the area intended to be engaged by a suitable actuator (e.g. a screwdriver) in order to control the adjustment thereof, is accessible from the upper base 75 of the body 8 of hinge 4. In particular, base 75 is visible also when body 8, with the flanged container 14 thereof and with device 2 for closing a door, was recessed and mounted in leaf 5.

Therefore, by conveniently acting on head 55 of the joining means 50, plate 47 moves close to (see FIG. 6) or away from (see FIG. 7) the lower base 13 of the flanged container 14 of the hinge body 8 and thus the distance varies between such a plate and washer 44 on which spring 42 abuts. In general, by acting on the joining means 50 which are also accessible when the body 8 of hinge 4 is inserted and mounted in leaf 5, the distance is varied of the second element 47, which is integral with said body 8, with respect to the first element 44, which is integral with the translating element 34, and thus the preloading level is varied of spring 42 interposed between said elements 47 and 44.

Advantageously, a further adjustment of the preloading level of spring 42 is thus made, before but especially after the installation of the hinge body 8 on leaf 5, which is more accurate with respect to said preliminary adjustment.

Conveniently, both the lower base 13 of the intermediate portion 18 of the flanged container 14 of hinge 4 and plate 47 are provided with through holes, 54 and 56, respectively, which are aligned with each other and are intended to be crossed by the translating element 34 which engages with the articulation arm 48 of hinge 4.

The operation of the improved device 2 for closing a door according to the invention is apparent from the above description.

In particular, in open hinge condition (see FIG. 4), i.e. when leaf 5 is rotated with respect to jamb 6, the arms 48, 60 of hinge 4 are rotated about the respective articulation pins.

In greater detail, the rotation of arm 48, to which hook 36 of the translating element 34 is constrained, induces a longitudinal translation motion of the element itself which causes it to partially come out of the flanged container 14 up to hinge 4 reaching the open condition (see FIG. 4). Moreover, the longitudinal translation of the translating element 34 causes washer 44 associated/integral with the translating element itself, to move close to plate 47 associated/integral with the flanged container 14 of hinge 4, thus causing the compression (loading) of spring 42.

Then, in order to automatically switch, i.e. without any intervention by the operator, from the open hinge condition (see FIG. 4) to the closed hinge condition (see FIG. 5), spring 42, which was previously loaded and compressed, is unloaded and lengthens to return to its resting condition and in doing so, causes the moving away of washer 44 from plate 47; moreover, the translating element 34, which is associated with washer 44 by means of nut 46, thereby is pushed towards the inside (i.e., towards the bottom) of the tubular stretch 90 of cavity 7 obtained in leaf 5.

In particular, during such an axial return translation of the translating element 34, through hook 36, the latter acts on the arm 48 of hinge 4, thus causing the rotation of this arm about the corresponding pin, and therefore the closing of the hinge itself. In essence, the extending return movement of spring 42 causes the automatic closing of hinge 4, and therefore the automatic closing of leaf 5 with respect to jamb 6.

It is understood that the closing speed of leaf 5 depends on the compression load of spring 42, and therefore also on the preloading level of the same, as is conveniently defined during the adjustment operations of device 2 for closing a door.

In particular, as mentioned, before mounting/inserting the hinge body 8 and device 2 for closing a door in/into cavity 7 obtained on leaf 5, the preloading level may be varied of spring 42 by acting on nut 46 or also on the joining means 50, thus adjusting the compression of the spring when opening the leaf and correspondingly also the closing speed of the leaf itself.

Advantageously, once the hinge body 8 and device 2 for closing a door have been installed in/inserted into cavity 7 obtained on leaf 5, the preloading level may be varied of spring 42 by acting on head 55 of the screws 51 which are accessible from the upper base 75 of the hinge body 8, thus adjusting the compression of the spring when opening the leaf and correspondingly also the closing speed of the leaf itself.

Advantageously, in an embodiment not depicted herein, device 2 for closing a door according to the first embodiment also may comprise a tubular casing for containing the components thereof. In particular, such a casing may have one end closed by a circular plate, for example, and the other end may be associated or provided with a further plate so as to thus define a containment structure to be then inserted into the corresponding tubular stretch 90 of cavity 7 obtained in leaf 5.

FIGS. 9 to 15 show a second embodiment of the improved device 2' for automatic closing of a door according to the invention. In particular, in such an embodiment, the device comprises a containment structure 3 which is intended to be associated with hinge 4.

In greater detail, the containment structure 3 of device 2' for closing a door consists of a tubular casing 20 which has one end closed by a circular plate 22 and the other end associated with a second plate 24.

Advantageously, a damper 28 is accommodated in the tubular portion 20 of the containment structure 3. In particular, the tubular body 26 is inserted in the tubular portion 20, which tubular body in turn accommodates therein a damper 28 which preferably comprises a cylindrical body 29 and a rod 30. Conveniently, the rod 30 of damper 28 always remains in contact with the inner surface of the closing plate 22 of the containment structure 3.

Also device 2' for closing a door comprises:

- preferably a rod-shaped translating element 34 intended to be hooked with an end thereof to an articulation arm 48 of hinge 4; advantageously, also the translating element 34 has at one end, a hook 36 intended to be engaged directly with a pin 38 provided at the end of one of the articulation arms 48 of hinge 4,
- elastic means 42 and in particular, a spring 42, preferably of the solenoid type, which is fitted about the translating element 34 and acts by compression between a first element 44, which is associated with the translating element 34, and a second element 47, which is associated with the body 8 of hinge 4.

Preferably, said first element comprises a washer 44 which is associated with/locked on the translating element 34 by the self-locking nut 46, while said second element comprises a plate 47 which is facing and associated with the second plate 24 and therefore is integral with the fixed containment structure 3.

Conveniently, the first element 44 and the second element 47 of the second embodiment of device 2' for closing a door have one or more of the above-described features concerning the first embodiment of device 2 for closing a door.

Preferably, but not necessarily, the base of the cylindrical body 29 of damper 28 always remains in contact with the end 32 of the translating element 34, which has the same features described above for the first embodiment shown in drawings 1 to 8.

Preferably, damper 28 is configured and installed so that it is compressed also in open hinge condition, namely so that it always remains in contact with and resting on plate 22 on one side, without ever being detached, and end 32 of the translating element 34 on the other side.

As will be better seen below, both damper 28 and spring 42 act on the translating element 34, with forces in opposed direction. In particular, spring 42 acts between the second element 47, which is integral with the fixed containment structure 3 and the body 8 of hinge 4, and the first element 44, which is integral with the translating element 34, while damper 28 acts between base 32 of the translating element 34 and the closing plate 22 of the tubular portion 20 of the fixed containment structure 3.

Advantageously, also in the second embodiment, by screwing the self-locking nut 46 onto the threaded portion of the translating element 34, the position of washer 44 held by said nut is varied with respect to plate 47, and thus a preliminary adjustment of the preloading level of spring 42 is carried out when the door closing device 2 is assembled, and in any case before the installation of the hinge body 8 on leaf 5.

Preferably, plates 47 and 24 have the same shape and conveniently, this corresponds to that of the lower base of the intermediate portion 18 of the flanged container 14 of hinge 4.

Plate 47 is associated with plate 24 of the containment structure 3 and of base 13 of the hinge body 8 by means of adjustable joining means 50.

Conveniently, the adjustable joining means 50 of the second embodiment of 2' for closing a door have one or more of the above-described features concerning the first embodiment of device 2 for closing a door.

Conveniently, both the hinge body 8, with the flanged container 14 thereof, and the plates 47 and 24 are provided with two pairs of through holes, 91, 92 and 93, respectively, which are aligned with each other and are intended to be crossed by the joining means 50.

Conveniently, the joining means 50 comprise screws 51 with an outer threaded portion which acts in conjunction with a corresponding threaded portion provided on the inner surface of the holes 91 of the flanged container 14 of the body 8 of hinge 4.

Advantageously, spacer discs 53 which are inserted in or provided in one piece with the shank of the screws 51, act on the non-facing surfaces of the plates 47 and 24. Conveniently, in the case of spacer discs 53 provided separately from the screws 51 (see FIG. 11), the joining means 50 also comprise locking means 57, e.g. nuts, which interact with a corresponding threaded portion of the screws 51 so as to thus overall define a bolt join which is easy to be disassembled and adjusted.

Conveniently, in a variant (not depicted), the joining means 50 may comprise end pins which are constrained to or are provide in one piece with the screws 51 and are engaged in the holes 92 and 93 obtained in the plates 47 and 24, respectively.

Advantageously, also in this embodiment, head 55 of the joining means 50, i.e. the area intended to be engaged by a suitable actuator (e.g. a screwdriver) in order to control the adjustment thereof, is accessible from the upper base 75 of the hinge body 8. In particular, base 75 is visible also when body 8, with the flanged container 14 thereof and with device 2' for closing a door, was recessed and mounted in leaf 5.

Therefore, by conveniently acting on head 55 of the joining means 50, the unit defined by the two plates 24 and 47 moves close to (see FIG. 6) or away from (see FIG. 7) the lower base 13 of the flanged container 14 and the hinge body 8 and thus the distance of plate 47 varies with respect to washer 44 on which spring 42 abuts. In general therefore, by acting on the joining means 50 which are also accessible when the body 8 of hinge 4 is inserted and mounted in leaf 5, the distance is varied of the second element 47, which is integral with said body 8, with respect to the first element 44, which is integral with the translating element 34, and thus the preloading level is varied of spring 42 interposed and acting between said two elements 47 and 44.

Advantageously, thereby a further adjustment of the preloading level of spring 42 is made, both before and after the installation of the hinge body 8 on leaf 5, which is more accurate with respect to said preliminary adjustment.

Conveniently, both the base of the intermediate portion 18 of the flanged container 14 of hinge 4 and the second plate 47 are provided with through holes, 54 and 56, respectively, which are aligned with each other and are intended to be crossed by the translating element 34 which engages with the articulation arm 40 of hinge 4.

Conveniently, according to one variant of the second embodiment of device 2' for closing a door not herein depicted, the latter also may not have the containment structure 3 and may be accommodated directly in the tubular stretch 90 defined in the housing cavity 7 obtained in leaf 5. In particular, in such a case, damper 28, and in greater detail rod 30 thereof, comes into contact with the bottom wall of cavity 7.

The operation of the improved device 2' for closing a door according to the invention is apparent from the above description.

In particular, in open hinge condition (see FIG. 12), i.e. when leaf 5 is rotated with respect to jamb 6, the arms 48, 60 of hinge 4 are rotated about the respective articulation pins.

In greater detail, the rotation of arm 48, to which is constrained hook 36 of the translating element 34, induces a longitudinal translation motion of the latter which causes it to partially come out of the containment structure 3 up to hinge 4 reaching the open condition (see FIG. 12). Correspondingly, also damper 28, which preferably is configured and installed so as to always be compressed between end 32 of the translating element 34 and the closing plate 22 of the containment structure 3, extends pushing so that the cylindrical body 29 comes out of rod 30 and thus moves away from the closing plate 22.

Moreover, the longitudinal translation of the translating element 34 causes washer 44 (first element) associated with the translating element itself, to move close to the second plate 47 (second element) associated with the fixed structure, thus causing the compression (loading) of spring 42.

Then, in order to automatically switch, i.e. without any intervention by the operator, from the open hinge condition (see FIG. 12) to the closed hinge condition (see FIG. 13), spring 42, which was previously loaded and compressed, is unloaded and lengthens to return to its resting condition and in doing so, pushes washer 44, and therefore the translating element 34 constrained thereto by nut 46, towards the inside of the containment structure 3.

In particular, during such an axial return translation of the translating element 34, through hook 36, the latter acts on the arm 48 of hinge 4, thus causing its rotation about the corresponding pin, and therefore the closing of the hinge.

Correspondingly, the axial return translation of the translating element 34 causes the compression of damper 28, and this pushes the cylindrical body 29 to return in rod 30 and to move close to the closing plate 22. In essence, in the axial return translation thereof, the translating element 34 is contrasted by damper 28.

Therefore, during the complete closing of hinge 4, or before the leaf reaches the closed configuration, and preferably when it defines an angle which is about 30° smaller with respect to such a closed configuration, damper 28 acts by slowing down the extending movement of spring 42 and contrasting the automatic closing stroke of leaf 5 with respect to jamb 6.

Conveniently, damper 28 may be configured and installed so as to contrast and slow down the extension movement of spring 42 from the beginning and for the whole automatic closing stroke of leaf 5 with respect to jamb 6.

Alternatively, damper 28 may be configured and installed so as to start contrasting and slowing down the extension movement of spring 42 for a portion alone of the automatic closing stroke of leaf 5 with respect to jamb 6, for example only at the initial or middle part of the closing stroke or preferably, at the final part of such a closing stroke.

Conveniently, also in this second embodiment, before mounting/inserting the hinge body 8 and device 2' for closing a door in/into cavity 7 obtained on leaf 5, the preloading level may be varied of spring 42 by acting on nut 46 or also on the joining means 50, thus adjusting the compression of the spring when opening the leaf and correspondingly also the closing speed of the leaf itself.

Advantageously, once the hinge body 8 and device 2 for closing a door have been installed/inserted in/into the cavity 7 obtained on leaf 5, the preloading level may be varied of spring 42 by acting on head 55 of the screws 51 which are accessible from the upper base 75 of the hinge body 8, thus adjusting the compression of the latter when opening the leaf and correspondingly also the closing speed of the leaf itself.

Conveniently, by varying the length of the tubular portion and/or the axial position of the closing plate 22 of the fixed containment structure 3 (for example, by replacing the plate with an elongated tubular stretch which is screwed into the tubular portion 20 and which is closed at one end), the angular position at which damper 28 begins its intervention to brake the automatic closing motion of leaf 5 may be adjusted.

Preferably, damper 28 is of the hydraulic type and comprises a cylindrical body 70 which contains a fluid (preferably oil but conveniently it could also be a pressurized gas) and a rod 71, at the end of which is associated the piston 72 which slides in the cylindrical body 70 so as to vary the volume of the first chamber 73 in which the fluid is contained.

It is understood that damper 28 may be installed in device 2' for closing a door so that termination 75 of the rod 71 thereof rests on plate 22, while the base of the cylindrical body 70 acts in conjunction with end 32 of the translating element 34, or also vice versa. Preferably, damper 28 is configured and installed so as to always be compressed, and therefore in contact, also when the hinge is in open condition, between end 32 of the translating element 34 and the closing plate 22 of the containment structure 3.

Therefore, when the hinge is in open condition, damper 28 is in its most extended condition with rod 71 substantially outside the cylindrical body 70 and chamber 73 containing the fluid, which arrives at the maximum volume thereof. Then, when switching from the open hinge condition to the closed hinge condition, the unloading of spring 42 and the subsequent axial return translation of the translating element 34, causes the compression of damper 28, i.e. the sliding of rod 71 and of piston 72 in the cylindrical body 70, so as to reduce the volume of chamber 73 and thus compress the fluid contained in the latter; therefore, the fluid thus compressed passes from the first chamber 73 to a second chamber 76 which is defined above piston 72, through certain passageways which preferably are defined in piston 72 and/or are provided between the latter and the inner wall of the cylindrical body 70.

Therefore, the damper comes into action close to the stroke end of automatic closing of leaf 5, which damper 28 thus slows down the stroke of the leaf itself following the resistance of the fluid contained in chamber 73 and the frictions which are generated due to the effect of the compression of piston 72 in the cylindrical body 70, thus dampening any knocks between jamb 6 and leaf 5.

Preferably, damper 28 is configured so that, during the compression thereof, the stroke of piston 72 in the cylindrical body 70 has at least two different speeds, in sequence, that of the successive stretch being conveniently greater than that of the preceding stretch.

In particular, the different sliding speeds of piston 72 may be obtained by intervening on the quantity of fluid and/or on the lengths and on the various combinations of diameter between the cylindrical body 70 and piston 72 so as to conveniently act on the passage lumen of the fluid from the first chamber 73 to the second chamber 76.

Preferably, according to one particularly advantageous embodiment of the present invention, damper 28 is configured and operates as shown in FIGS. 14 and 15. In greater detail, in such an embodiment, the cylindrical body 70 has:

- a first portion 78 which is shaped and sized so that the stroke of piston 72 compresses the fluid which thus passes from the first chamber 73 to the second chamber 76 through a first passage lumen, i.e. conveniently induces a significant braking effect which thus causes a first sliding speed of piston 72,
- a second portion 80 which has a larger cross section than the first portion 78, and/or has one or more side hollows 81 defined on the inner walls of the cylindrical body itself so that the fluid, which is compressed by piston 72, passes from the first chamber 73 to the second chamber 76 through a second lumen, which has a greater passage section than that of the first portion; this causes less resistance by the fluid and therefore a lesser braking effect with respect to that of the first portion, thus causing a sliding speed of piston 72 which is different from and greater than that of the first portion 78.

Such a type of damper 28 is particularly advantageous because before leaf 5 reaches the closed configuration, and preferably when an angle about 30° smaller than such a closed configuration is defined, piston 72 first crosses the first portion 78 of the cylindrical body 70, where stroke 85 thereof undergoes increased resistance, which thus causes a significant slowdown of the extension of spring 42 and of the automatic closing stroke of leaf 5 towards jamb 6 in order to damper the sudden contact therebetween.

When piston 72 then enters the second portion 80, the resistance opposing stroke 87 thereof is less, and therefore also the slowing down/contrasting action of the extension movement of spring 42 is decreased, which thus gives leaf 5 such a force as to allow the spring lock (quick release) of traditional type associated with the leaf itself to be engaged and enter the corresponding seat obtained in jamb 6.

Conveniently, by varying the length of the tubular portion and/or the axial position of the closing plate 22 of the fixed containment structure 3 (for example, by replacing the plate with an elongated tubular stretch which is screwed into the tubular portion 20 and which is closed at one end), not only may the angular position at which damper 28 begins its intervention to brake the automatic closing motion of leaf 5 be adjusted, but also the angular position (which preferably is about 5°) at which the damper decreases the braking action thereof so as to allow the engagement of the spring lock of the leaf in the corresponding seat obtained in jamb 6.

From the above, it is apparent in both the embodiments herein described and depicted that the improved device for closing a door according to the invention is quite advantageous with respect to traditional ones, because:

- it is particularly compact and may be completely recessed in the leaf, thus avoiding any alteration to the appearance of the door,
- it is easy to be applied to multiple types of hinges, including traditional hidden ones, by simply making through holes for constraining the plates of the door closing device itself and for passing the rod which is hooked on the arm of the hinge itself,
- it is simple and quick to be assembled and mounted,
- it allows the closing speed of the leaf to be easily and accurately adjusted before the mounting of the hinge, but especially once it has been mounted on the leaf.

Furthermore, in addition to the advantages obtained by means of the first embodiment, the second embodiment of the improved device according to the invention is just as advantageous because:

- it allows the angular position to be adjusted, in which the braking of the automatic closing motion of the leaf itself starts,
- it allows both the slowing down of the automatic closing of the leaf so as to avoid sudden contacts between the leaf itself and the jamb, and the engagement of the spring lock associated with the leaf in the corresponding seat obtained in the jamb.

The invention claimed is:

1. A device (2, 2') for automatic closing of a door, to be applied to a hidden hinge (4) comprising two bodies (8, 10), which are articulated with each other by at least one pair of arms (48, 60) and are constrainable to a leaf (5) and to a fixed structure (6), respectively, said device (2, 2') being adapted to be constrained to one (8) of said two bodies of said hinge (4) and to be inserted, together with said one of said two bodies, into a corresponding cavity (7) obtained in said leaf (5), said device (2, 2') comprising:

a translating element (34) adapted to be engaged with an articulation arm (48) of said hinge (4);

an elastic member (42) interposed between a first element (44) adapted to translate with said translating element (34) and a second element (47) associated with said body (8) of said hinge (4) to which said device (2, 2') is intended to be constrained, said elastic member (42) being configured to be loaded during an opening rotation of said leaf (5) associated with said hinge (4) and to return mechanical energy stored in said opening rotation to said translating element (34) in order to cause the automatic closing of said leaf (5) associated with said hinge (4);

a system (50, 51, 52, 53, 55, 57) adapted to vary a preloading of said elastic member (42), and therefore an automatic closing speed of said leaf (5), said system (50, 51, 52, 53, 55, 57) being configured to modify a distance between said first (44) and said second (47) elements between which said elastic member (42) is interposed, wherein said system (50, 51, 52, 53, 55, 57) adapted to vary the preloading of said elastic member (42):

is configured to be controlled from a base (75) of said body (8) of said hinge (4), which is visible also once said device (2, 2') has been inserted into said cavity (7) obtained in said leaf (5), and comprises a system adapted to modify, when adjusting said device (2, 2') for automatic closing of a door, a distance between said second element (47) and a lower base of said body (8) of said hinge (4), to which said device (2, 2') is adapted to be constrained.

2. A device (2') according to the claim 1, further comprising a fixed containment structure (3) that is adapted to be constrained to the lower base of said body (8) of said hinge (4), to which said device (2) is intended to be constrained, and that has a tubular portion (20) accommodating said translating element (34) and said elastic member (42) therein.

3. A device according to claim 1, wherein said first element (44) is translationally integral with said translating element (34), and wherein said second element (47) is integral with said body (8) of said hinge (4).

4. A device according to claim 1, wherein said second element (47) is associated with the lower base of said body (8) of said hinge (4), and wherein said elastic member (42) is adapted to be controlled from an upper base (75) of said body (8) of said hinge (4) to which said device (2, 2') is adapted to be constrained, so as to adjust a closing speed of said leaf (5) once said device (2, 2') and said body (8) of said hinge (4) have been inserted into said cavity (7) obtained in said leaf (5).

5. A device according to claim 1, wherein said translating element (34) is provided, at a first end, with a member (36) hooking to an articulation arm (48) of said hinge (4).

6. A device according to claim 2, wherein said system adapted to vary the preloading of said elastic member (42) comprises adjustable joining means (50) for connecting said second element (47) to said body (8) of said hinge (4), to which said device (2, 2') is adapted to be constrained, said adjustable joining means (50) being adjustable by acting on an end (55) thereof configured to be accessed at an upper base (75) of said hinge body (8).

7. A device according to claim 6, wherein the device is configured so that, by acting on said adjustable joining means (50), a position of said second element (24, 47) is varied, said second element being integral with one or both of said containment structure (3) or with the lower base of said hinge body (4), with respect to said first element (44) which is integral with said translating element (34) and which adjusts, during installation, a degree of the preloading of said elastic member (42).

8. A device according to claim 1, wherein said second element associated with the lower base (13) of said body of said hinge (4) comprises at least one plate (24, 47).

9. A device according to claim 1, further comprising further means (46) for varying the preloading of said elastic member (42), said further means (46) being configured to change the distance between said first (44) and said second (47) elements, between which said elastic member (42) is interposed, and being controllable only before said closing device (2, 2') is inserted into said cavity (7) obtained in said leaf (5).

10. A device according to claim 9, wherein said further means (46) are configured to modify a position of said first element (44) along said translating element (34).

11. A device according to claim 6, wherein said second element (24, 47) is associated with one or both of said containment structure (3) or with the lower base of said body of said hinge (4) with said adjustable joining means (50).

12. A device according to claim 2, wherein said elastic member (42) acts between at least one plate (24, 47), which is integral with said fixed containment structure (3) and is adapted to be constrained to the lower base of said body of said hinge (4), and a washer (44) constrained to said translating element (34).

13. A device (2') according to claim 2, further comprising a damper (28, 29, 30, 70, 71, 72) which is configured so that, for all or at least a part of said automatically closing of said door, said damper acts on said translating element (34) to dissipate energy of said elastic member (42), thereby slowing down an automatic closing speed of the leaf (5) associated with said hinge (4).

14. A device (2') according to claim 13, wherein said damper (28, 29, 30, 70, 71, 72) is installed and configured so as to be interposed between an end (32) of said translating element (34) opposite to said first end provided with hooking means (36), and a bottom of the cavity (7) obtained in said leaf (5), or of a closing base (22) of the tubular portion (20) of said fixed containment structure (3).

15. A device according to claim 14, wherein said device is configured so that by modifying an axial position of the bottom of the cavity (7) obtained in said leaf (5) or of the closing base (22) of the tubular portion (20) of said fixed containment structure (3), an angular position of an automatic closing stroke of said hinge (4) is adjusted, at which angular position the damper (28) begins to act to dissipate the energy of said elastic member (42).

16. A device according to claim 15, wherein said damper (28) is configured so that, during said automatically closing of said hinge (4), said damper (28) acts on said translating element (34) firstly to dissipate greatly the energy of said elastic member (42) and slow down the automatic closing speed of the leaf (5) associated with said hinge (4), and then to dissipate the elastic energy of said elastic member (42) to a lower extent and provide for a spring lock (5) associated with said hinge (4) to be engaged in a corresponding seat obtained in said fixed structure (6).

17. A device according to claim 13, wherein said damper (28) is configured so that during a compression thereof, a stroke of a piston (72) in a cylindrical body (70) of said damper has at least two different sliding speeds, in sequence, a successive one of which is greater than a preceding one.

18. An automatic closing system for automatically closing a leaf (5) with respect to a fixed structure (6), said system comprising at least one hidden hinge (4) for articulating said leaf (5) with respect to said fixed structure (6), said hidden hinge (4) comprising:

a first body (8), with a corresponding first containment seat (14), adapted to be inserted into a corresponding first cavity (7) obtained in said leaf (5);

a second body (10), with a second containment seat (15), adapted to be recessed in a corresponding second cavity obtained in said fixed structure (6);

rocker-shaped arms (48, 60) associated with said first and said second bodies (8, 10) so as to allow a rotation of the leaf (5) with respect to said fixed structure (6); and a device (2, 2') for automatic closing of a door, constrained to a base (13) of said first body (8) of said hinge (4) and adapted to be inserted, together with said first body (8), into said first cavity (7) obtained in said leaf (5), said device comprising:

a translating element (34) adapted to be engaged with an articulation arm (48) of said hinge (4);

an elastic member (42) interposed between a first element (44) adapted to translate with said translating element (34) and a second element (47) associated with said body (8) of said hinge (4) to which said device (2, 2') is intended to be constrained, said elastic member (42) being configured to be loaded during an opening rotation of said leaf (5) associated with said hinge (4) and to return mechanical energy stored in said opening rotation to said translating element (34) in order to cause the automatic closing of said leaf (5) associated with said hinge (4);

a system (50, 51, 52, 53, 55, 57) adapted to vary a preloading of said elastic member (42), and therefore an automatic closing speed of said leaf (5), said system (50, 51, 52, 53, 55, 57) being configured to modify a distance between said first (44) and said second (47) elements between which said elastic member (42) is interposed, wherein said system (50, 51, 52, 53, 55, 57) adapted to vary the preloading of said elastic member (42):

is configured to be controlled from a base (75) of said body (8) of said hinge (4), which is visible also once said device (2, 2') has been inserted into said cavity (7) obtained in said leaf (5), and comprises a system adapted to modify, when adiusting said device (2, 2') for automatic closing of a door, a distance between said second element (47) and a lower base of said body (8) of said hinge (4), to which said device (2, 2') is adapted to be constrained.

19. An automatic closing system according to claim 18, wherein said translating element (34) and said elastic member (42) are configured to be accommodated directly in said first cavity (7) obtained in the leaf (5), without being inserted in a containment structure.

20. An automatic closing system according to claim 18, wherein said translating element (34) and said elastic member (42) are configured to be accommodated in a containment structure (3), which is adapted to be inserted into said first cavity (7) obtained in the leaf (5).

* * * * *